US006532938B1

(12) United States Patent
Mahr et al.

(10) Patent No.: US 6,532,938 B1
(45) Date of Patent: Mar. 18, 2003

(54) FUEL INJECTION SYSTEM

(75) Inventors: Bernd Mahr, Plochingen (DE); Martin Kropp, Korntal-Muenchingen (DE); Hans-Christoph Magel, Pfullingen (DE); Wolfgang Otterbach, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/807,374

(22) PCT Filed: Aug. 15, 2000

(86) PCT No.: PCT/DE00/02785

§ 371 (c)(1),
(2), (4) Date: May 21, 2001

(87) PCT Pub. No.: WO01/12982

PCT Pub. Date: Feb. 22, 2001

(30) Foreign Application Priority Data

Aug. 16, 1999 (DE) ..... 199 38 169

(51) Int. Cl.[7] ..... F02M 63/00
(52) U.S. Cl. ..... 123/447; 123/456; 123/467
(58) Field of Search ..... 123/446, 447, 123/456, 467, 506

(56) References Cited

U.S. PATENT DOCUMENTS

| | | | | | |
|---|---|---|---|---|---|
| 5,213,084 | A | * | 5/1993 | Linder et al. | 123/456 |
| 5,456,233 | A | * | 10/1995 | Felhofer | 123/447 |
| 5,732,679 | A | * | 3/1998 | Takahashi et al. | 123/467 |
| 6,189,509 | B1 | * | 2/2001 | Froment | 123/467 |
| 6,205,978 | B1 | * | 3/2001 | Zoeller | 123/456 |

FOREIGN PATENT DOCUMENTS

| | | | | |
|---|---|---|---|---|
| AT | 002961 | * | 7/1999 | F02M/45/04 |
| DE | 2907279 | * | 8/1980 | F02M/51/00 |
| DE | 4330720 | * | 3/1995 | F02M/59/00 |
| DE | 19618698 | * | 11/1997 | F02M/61/18 |
| WO | WO 99/18349 | * | 4/1999 | F02M/63/00 |

* cited by examiner

*Primary Examiner*—Tony M. Argenbright
(74) *Attorney, Agent, or Firm*—Ronald E. Greigg

(57) ABSTRACT

A fuel injection system includes a pressure storage chamber and one injector assigned to each cylinder, which injector can be connected to the pressure storage chamber via a pressure line that includes a metering valve. Using a single 2/2-way valve as a metering valve per cylinder makes for a more-economical manufacture of a fuel system, especially for small engines. The fuel injection is done under pressure control.

16 Claims, 7 Drawing Sheets

FUEL INJECTION SYSTEM

CROSS-REFERENCE TO RELATED APPLICATIONS

This application is a 35 USC 371 application of PCT/DE 00/02785 filed on Aug. 15, 2000.

BACKGROUND OF THE INVENTION

1. Field of the Invention

The invention relates to a fuel injection system, and particularly to a fuel injection system for internal combustion engines including a metering valve in the fuel injection pressure line.

2. Description of the Prior Art

For the sake of better understanding of the specification and claims, several terms will first be explained: The fuel injection system according to the invention is embodied as pressure-controlled. Within the scope of the invention, the term pressure-controlled fuel injection system is understood to mean that by the fuel pressure prevailing in the nozzle chamber of an injector, a valve member is moved counter to the action of a closing force (spring), so that the injection opening is uncovered for an injection of the fuel from the nozzle chamber into the cylinder. The pressure at which fuel emerges from the nozzle chamber into a cylinder of an internal combustion engine is called the injection pressure while the term system pressure is understood to mean the pressure at which the fuel is available or kept in reserve within the fuel injection system. Fuel metering means furnishes a defined fuel quantity for injection. The term leakage is understood to mean a quantity of fuel which occurs in operation of the fuel injection system (such as guide leakage), which is not used for injection, and which is pumped back to the fuel tank. The pressure level of this leakage can have a static pressure, in which case the fuel is pressure-relieved to the pressure level of the fuel tank.

In common rail systems, the injection pressure can be adapted to the load and rpm. For noise abatement, a preinjection is often performed in this case. Pressure-controlled injection is known to be favorable for reducing emissions. In the known pressure-controlled common rail systems, however, either one 3/2-way valve, which is complicated to manufacture, or two 2/2-way valves are used per injector.

SUMMARY OF THE INVENTION

To lower the cost of producing the fuel system, especially for small engines, a fuel injection system is proposed. Using a single 2/2-way valve, as the metering valve, per cylinder leads to a more-economical system. After the termination of injection, relief of the nozzle chamber by means of a pressure relief valve or a pressure relief throttle, which are disposed in the communication of the pressure storage chamber with the injector, is necessary to avoid a postinjection. The use of a permanently open and additionally actuatable pressure relief throttle makes it easier to design the system without "after-injections". An additional hydraulic closing force on the valve member speeds up the closing operation and also prevents unwanted opening of the valve member from pressure fluctuations in the system. If instead of a seat-type or blind bore nozzle the injector has a vario-nozzle or vario-register nozzle, then the course of injection can be adapted even better to the requirements of the engine.

BRIEF DESCRIPTION OF THE DRAWINGS

The foregoing and other features and advantages of the invention will be apparent from the detailed description contained below, taken with the drawings, in which.

DESCRIPTION OF THE EXEMPLARY EMBODIMENTS

Figure 1:
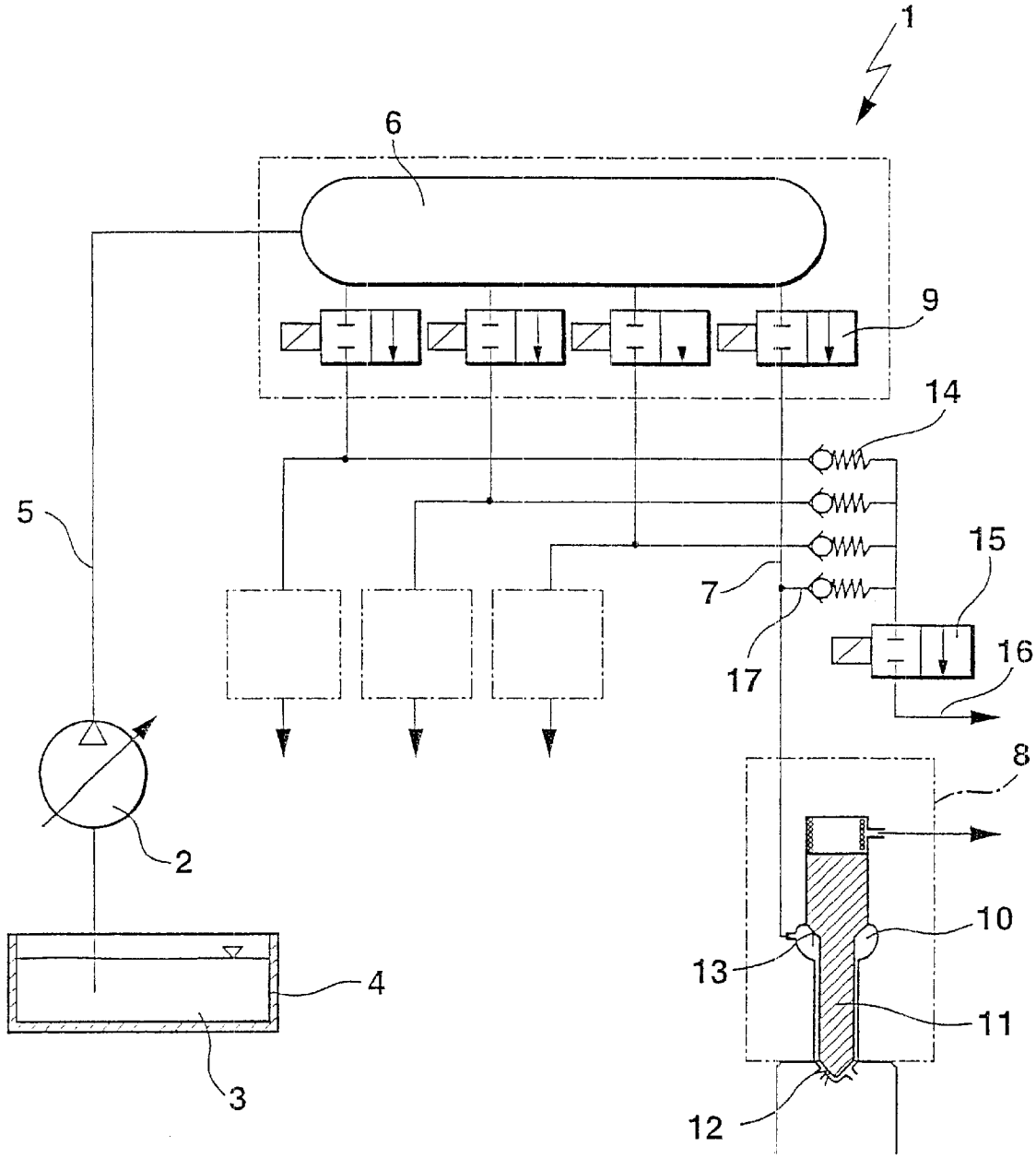
FIG. 1 is a schematic illustration of a pressure-controlled fuel injection system embodying the invention.

In the first exemplary embodiment of a pressure-controlled fuel injection system 1 shown in FIG. 1, a quantity-controlled fuel pump 2 pumps fuel 3 from a tank 4 via a feed line 5 into a central pressure storage chamber 6 (common rail), from which a plurality of pressure lines 7, corresponding to the number of individual engine cylinders, lead to the individual injectors 8 (injection devices), which protrude into the combustion chamber of the internal combustion engine to be supplied. FIG. 1 shows only one of the injectors 8 in detail. With the aid of the fuel pump 2, a system pressure is created and stored in the pressure storage chamber 6 at about 300 to about 1800 bar.

In the region of the pressure storage chamber 6, there are metering valves 9 connected in each pressure line 7, which metering valves are embodied as 2/2-way valves. Each metering valve 9 may be a directly actuated, fuel-balanced magnet valve or it can be a piezoelectric actuator with a corresponding coupler chamber. The injection for each cylinder is done in pressure-controlled fashion with the aid of the metering valve 9. The pressure line 7 connects the pressure storage chamber 6 with a nozzle chamber 10. The injection takes place with the aid of a pistonlike valve member 11, which is axially displaceable in a guide bore, that has a conical valve sealing face 12 on one end, with which it cooperates with a valve seat face on the injector housing of the injector 8. Injection openings are provided on the valve seat face of the injector housing. Inside the nozzle chamber, a pressure face 13 pointing in the opening direction of the valve member 11 is exposed to the pressure prevailing in that chamber, which is delivered to the nozzle chamber 10 via the pressure line 7. All the pressure lines 7 are connected via check valves 14 to a central pressure relief valve 15, that is, one pressure relief valve for all the pressure lines 7, which enables pressure relief of a pressure line 7 after the injection. During the injection event, the applicable pressure line 7 is disconnected from the leakage line 16. The check valves 14 prevent fuel from the pressure line 7 needed for the injection from being able to reach another pressure line 7 that is not needed at the time.

The preinjection is effected with the pressure relief valve 15 closed and the metering valve 9 opened; the latter is supplied with electric current to open it. After the opening of the metering valve 9, a high-pressure fuel wave proceeds in the pressure line 7 to the nozzle chamber 10. The valve member 11 is lifted from the valve seat face counter to a restoring force, and the injection event can begin. The high-pressure fuel wave reaches a closed leakage line 17 as well. This branching reduces the pressure of the fuel flowing into the nozzle chamber 10 compared to the pressure in the pressure storage chamber 6. The preinjection is therefore done at a lesser pressure than the system pressure that prevails in the pressure storage chamber 6. Given a suitable design of the geometries of the pressure lines 7, leakage lines 17 and nozzle chamber 10, the reduced fuel pressure wave is precisely large enough that only the preinjection takes place, and no after-injection can occur. Reflected fuel pressure waves are damped by the branching to the leakage line 17.

After the preinjection, with the metering valve 9 and the pressure relief valve 15 closed, a pressure level prevails in the pressure line 7 that is less than the opening pressure for lifting the valve member 11. If the metering valve 9 is opened again now, the main injection occurs with a higher pressure compared to the preinjection, since the pressure line 7 is not pressure-relieved and an increase in the injection pressure is achieved by reflection of pressure waves. For terminating the main injection, the metering valve 9 is closed and the pressure relief valve 15 is opened. The pressure line 7 is relieved. For injection into the next cylinder, the pressure relief valve 15 is closed again.

The pressure lines 7 and leakage lines 17 should be embodied equally in terms of the line length, in order to create the same hydraulic conditions for all the injectors 8.

Figure 2:
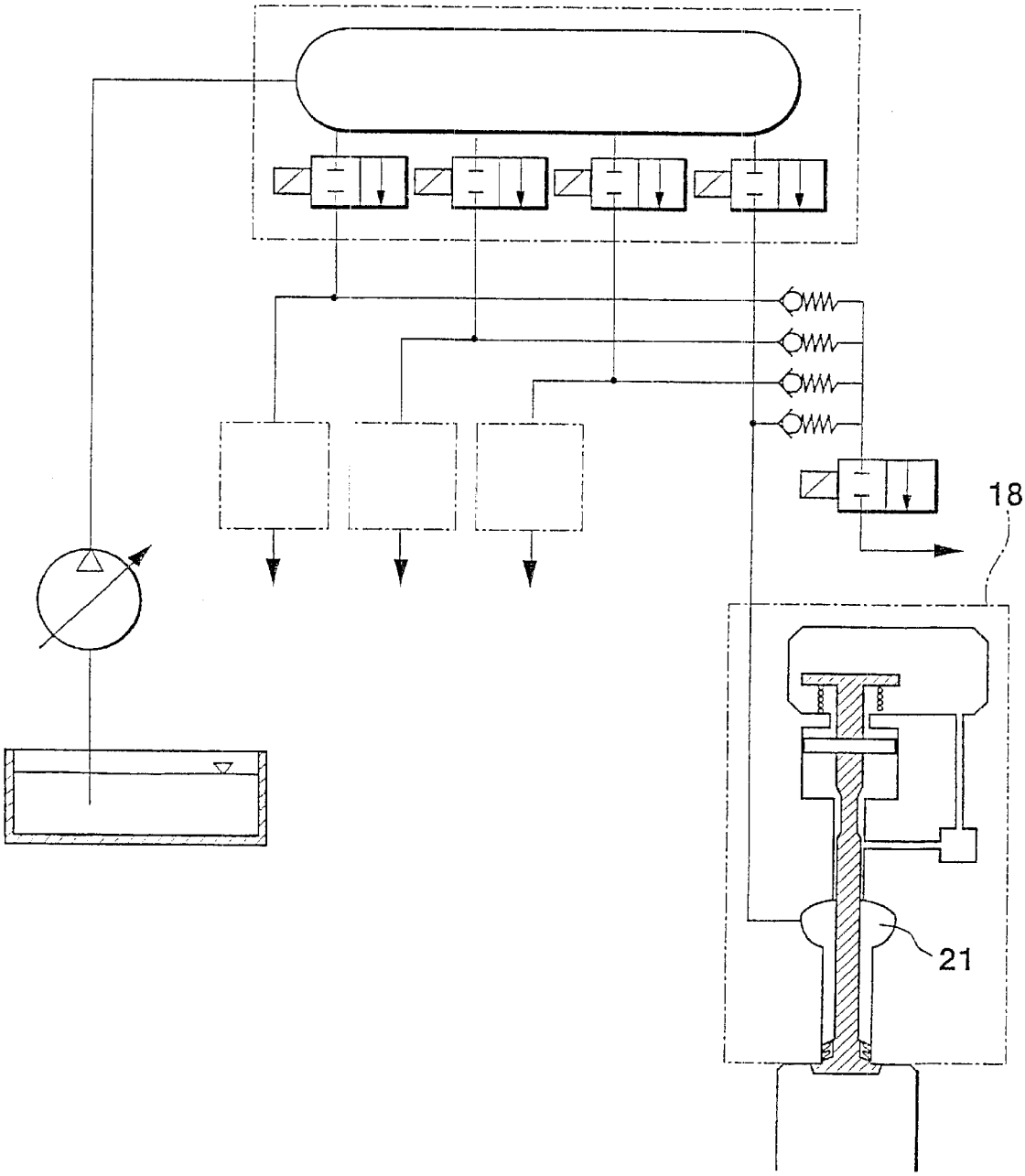
FIG. 2 is a schematic illustration of the fuel injection system of FIG. 1 with a different injector construction.

The injector 8 of FIG. 1 has a seat-type or blind bore nozzle. FIG. 2, instead of this geometry, shows a vario-nozzle or vario-register nozzle of an injector 18 of a second exemplary embodiment. The course of injection can be adapted even better to the requirements of the engine. The triggering of the valve member 21 or of a hydraulic stroke stop of the valve member 21 can be done either locally inside the injector or centrally and simultaneously for all the injectors.

Figure 3:
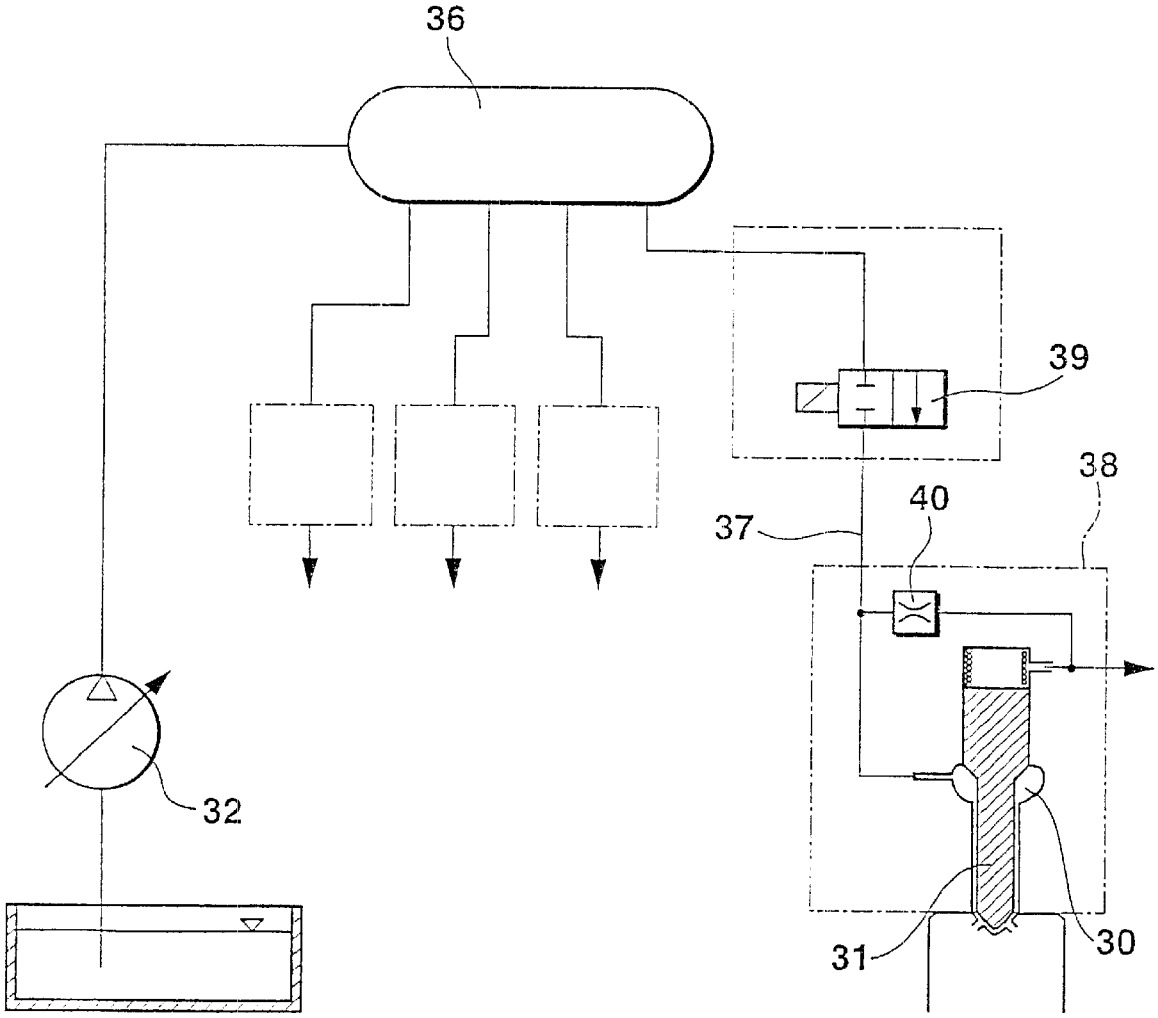
FIG. 3 is a schematic illustration of a different fuel injection system embodying the invention.

In FIG. 3, the construction of a third exemplary embodiment of the invention can be seen. A fuel pump 32 generates a system pressure, so that fuel can be stored in a pressure storage chamber 36 at a pressure of 300 to 1600 bar. The metering of fuel from the pressure storage chamber 36 to each cylinder is performed with the aid of pressure lines 37 and metering valves 39, of which only one each is shown with a reference numeral in FIG. 3. The injection is done under pressure control by an injector 38 with a valve member 31, counter to the pressure of a restoring force. As the injector, a simple nozzle or a two-spring nozzle holder can be used. The requisite relief of the pressure line 37 and of a nozzle chamber 30 after the injection is done by means of a pressure relief throttle 40, which connects the pressure line 37 with a leakage line. The pressure relief throttle 40 can be located in the injector 38 or on the metering valve 39, which is embodied by a 2/2-way valve.

Figure 4:
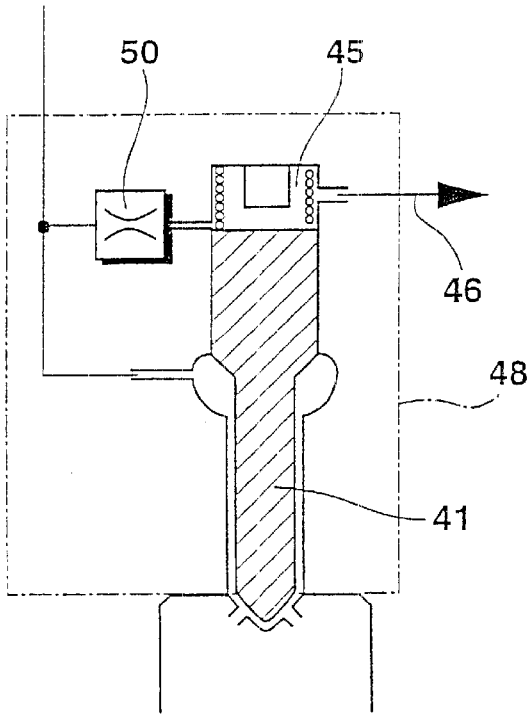
FIG. 4 is a schematic illustration of the construction of an injector for the fuel injection system of FIG. 3.

In FIG. 4, upon a motion of a valve member 41 of an injector 48 in the opening direction, an inflow opening between a pressure relief throttle 50 and a spring chamber 45 is closed. During the injection event, the communication between the pressure relief throttle 50 and a leakage line 46 is therefore interrupted and is restored again after the end of the injection event.

Figure 5:
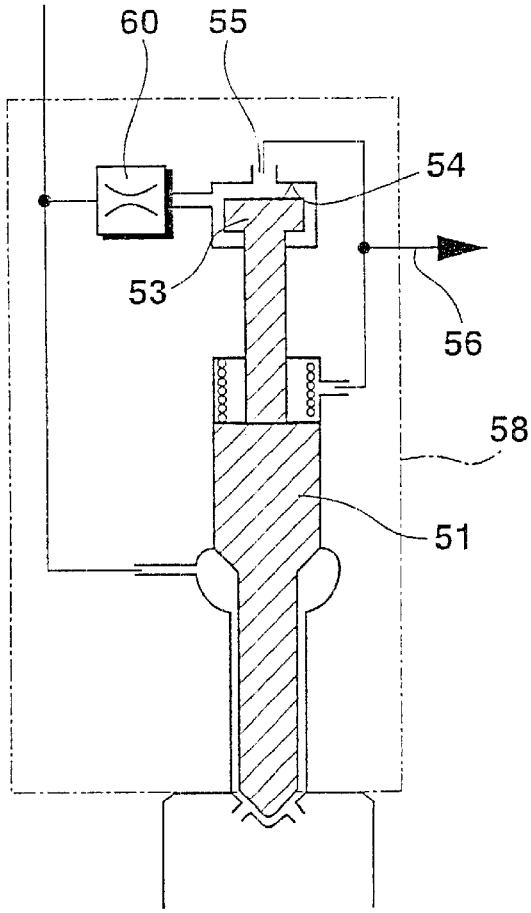
FIG. 5 is a view similar to FIG. 4 illustrating a different construction of an injector for the fuel injection system of FIG. 3.

In FIG. 5, a valve member 51 of an injector 58 communicates with a pressure piece whose end 53 remote from the injection opening can strike a pressure face 54. As a consequence of the motion of the valve member 51 and the pressure piece, the end 53 closes an outflow bore 55, so that the communication of a pressure relief throttle 60 with a leakage line 56 is interrupted during the injection event.

Figure 6:
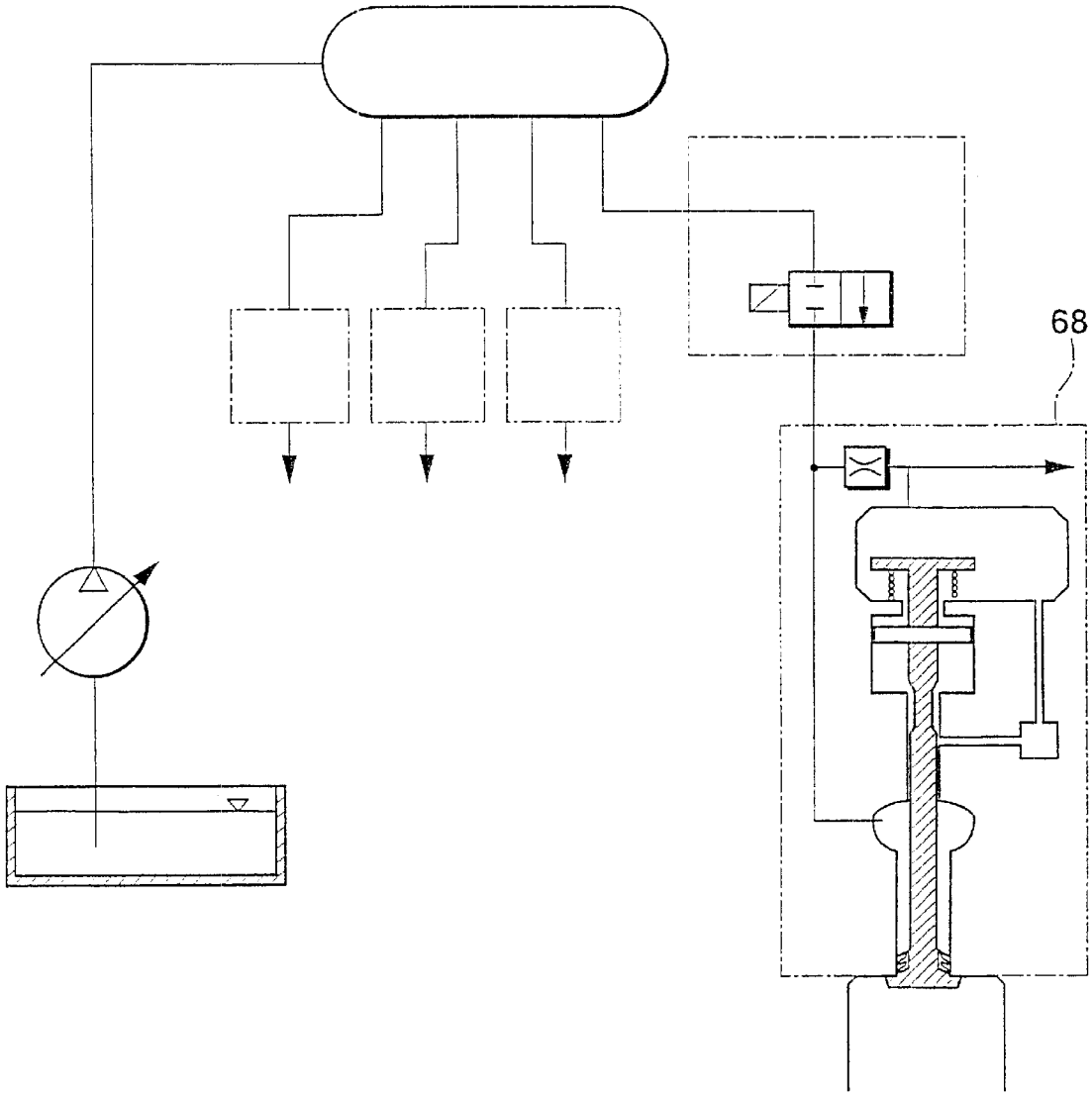
FIG. 6 is a schematic illustration of a further fuel injection system embodying the invention.

Instead of a seat-type or blind bore nozzle of the injector 58, a vario-nozzle or vario-register nozzle of an injector 68 may be used (FIG. 6).

Figure 7:
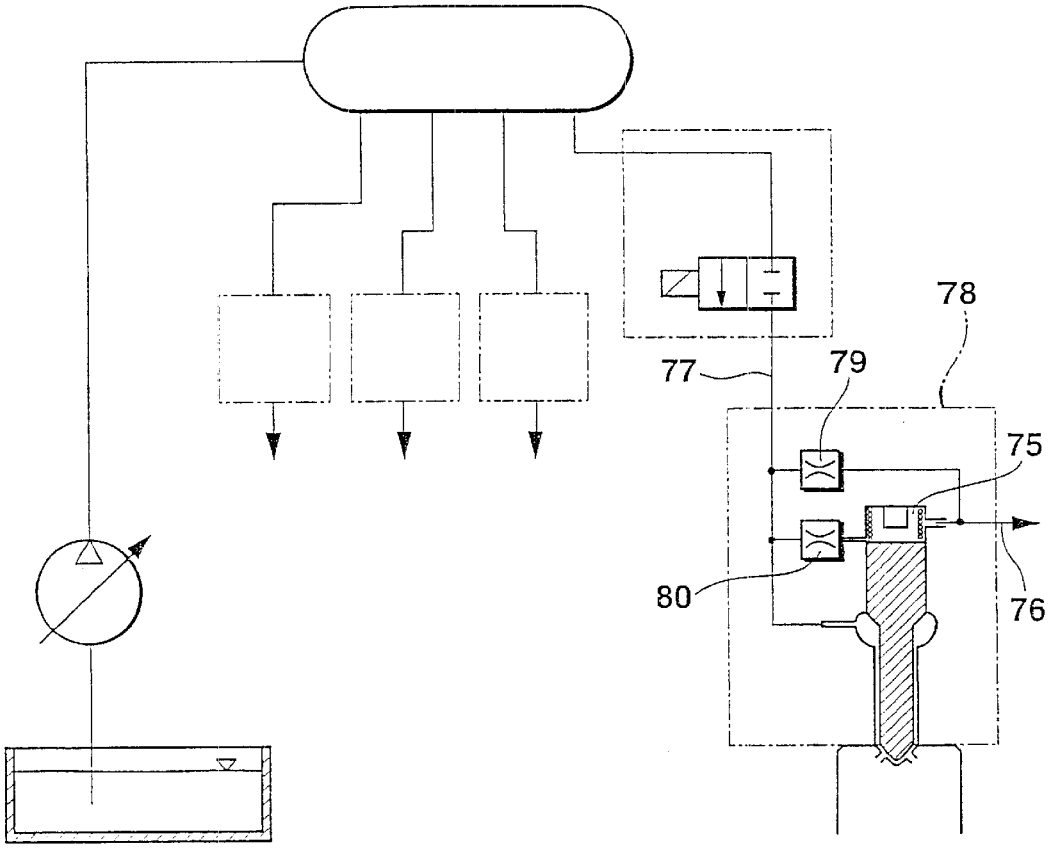
FIG. 7 is a schematic illustration of a further fuel injection system embodying the invention.

A fuel injection system in FIG. 7 has an injector 78, which has a first pressure relief throttle 79 and a second pressure relief throttle 80. Via the pressure relief throttle 79, the pressure line 77 has a permanently open communication with the leakage line 76. Via the pressure relief throttle 80 and a spring chamber 75, the pressure line 77 communicates with the leakage line 76 only when the injection opening is closed. In addition to the embodiment of FIG. 3, the embodiment of FIG. 7 therefore has, along with a pressure relief throttle 79 that is always open, a further pressure relief throttle 80 that can be closed by a stroke of the valve member. The smaller pressure relief throttle 79 leads to lesser leakage during the injection. Upon termination of the injection, the pressure in the nozzle chamber initially drops only via the pressure relief throttle 79, and the valve member begins its closing operation. As a result, the still-closed pressure relief throttle 80 is opened, so that the closing operation of the valve member is greatly accelerated. The injection per se by means of the fuel injection system of FIG. 7 is done analogously to that according to FIG. 3. The additional pressure relief throttle 80 leads to a design of a fuel injection system without any unwanted postinjection.

Figure 8:
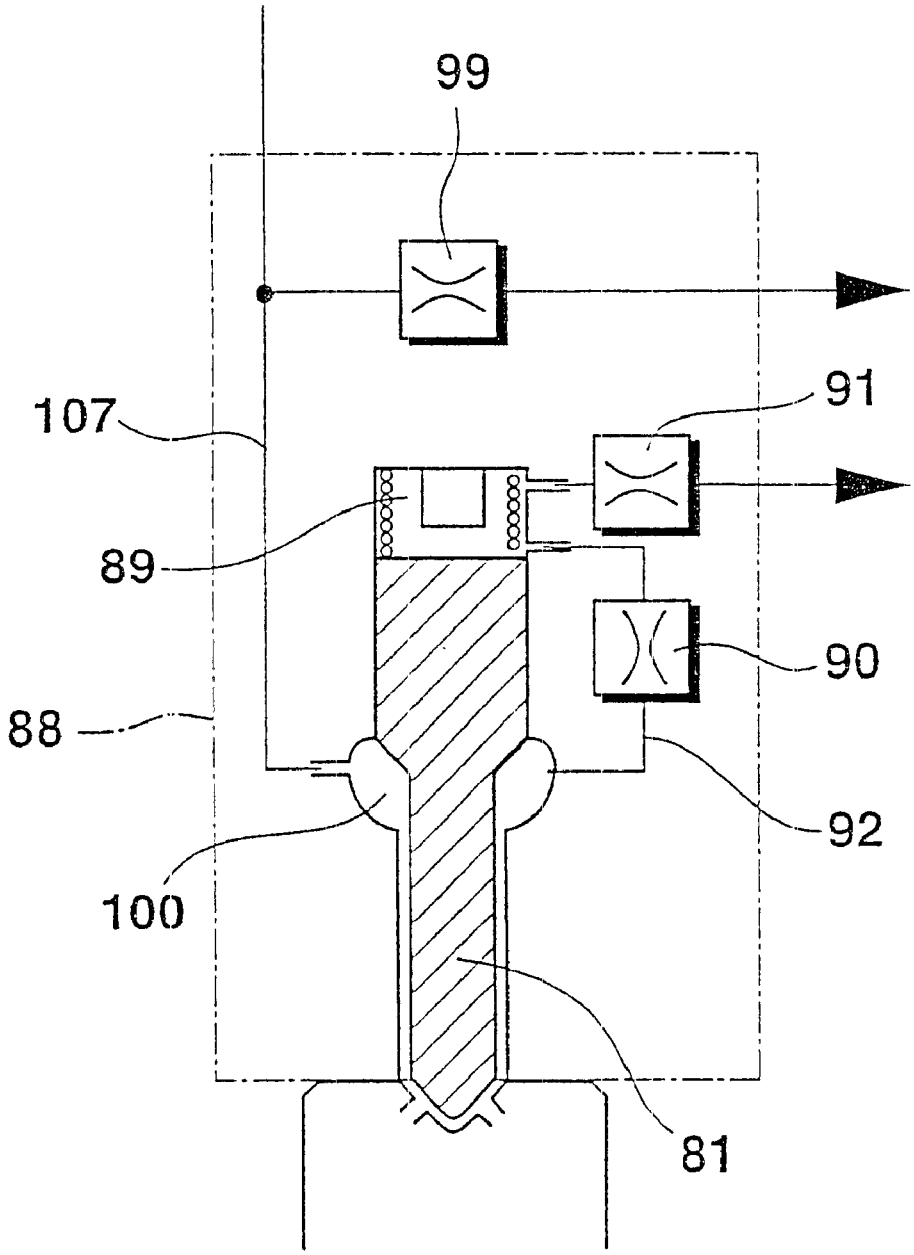
FIG. 8 is a schematic illustration of a different construction of an injector for the fuel injection system of FIG. 7.

In addition to a mechanical restoring force, in the case of an injector 88 as shown in FIG. 8, a hydraulic closing force also acts on a valve member 81, in order to close the injection opening of the injector 88. Upon movement of the valve member 81 in the opening direction, fuel is positively expelled from a spring chamber 89 and impounded at the throttle 91. The valve member 81 must be moved counter to a hydraulic pressure. A separate line 92 connects a nozzle chamber 100 with the spring chamber 89 and contains the pressure relief throttle 90. A further pressure relief throttle 99 communicates with a pressure line 107, which connects the nozzle chamber 100 with a pressure storage chamber. Different pressure areas in the nozzle chamber and the spring chamber can be used.

The foregoing relates to preferred exemplary of embodiments of the invention, it being understood that other variants and embodiments thereof are possible within the spirit and scope of the invention, the latter being defined by the appended claims.

What is claimed is:

1. In a fuel injection system for an internal combustion engine, the system having a pressure storage chamber (6; 36) and one injector (8; 18; 38; 58; 78; 88), assigned to each engine cylinder, that can be connected to the pressure storage chamber (6; 36) via a pressure line (7; 37; 77; 107) containing a metering valve (9; 39), the improvement wherein the metering valve (9; 39) is a 2/2-way valve, and that the fuel injection is effected in pressure-controlled fashion, wherein the pressure lines (7) communicate with leakage lines (17) that have check valves (14) and are connected to at least one pressure relief valve (15).

2. The fuel injection system of claim 1, wherein the injector (8) has a seat or blind bore nozzle as its injection opening.

3. The fuel injection system of claim 1 wherein the injector (18) has a vario-nozzle or vario-register nozzle as its injection opening.

4. The pressure-controlled fuel injection system of claim 1 wherein a nozzle chamber (100) of the injector (88) communicates with a spring chamber (89) of the injector (88) via a connecting line (92) that contains a pressure relief throttle (90).

5. In a fuel injection system for an internal combustion engine, the system having a pressure storage chamber (6; 36) and one injector (8; 18; 38; 58; 78; 88), assigned to each engine cylinder, that can be connected to the pressure storage chamber (6; 36) via a pressure line (7; 37; 77; 107) containing a metering valve (9; 39), the improvement wherein the metering valve (9; 39) is a 2/2-way valve, and that the fuel injection is effected in pressure-controlled fashion, wherein one pressure line (37) each is connected to a leakage line via at least one pressure relief throttle (40) and wherein the connection with the leakage line (46; 56) is interrupted during the injection event by the motion, occurring in the opening direction, of a displaceable valve member (41; 51) of the injector (48; 58), which valve member seals off an injection opening.

6. The fuel injection system of claim 5, wherein the pressure line (77; 107) additionally communicates with a further leakage line that contains a pressure relief throttle (79; 99).

7. The fuel injection system of claim 6, wherein the injector (8) has a seat or blind bore nozzle as its injection opening.

8. The fuel injection system of claim 6 wherein the injector (18) has a vario-nozzle or vario-register nozzle as its injection opening.

9. The fuel injection system of claim 5, wherein the injector (8) has a seat or blind bore nozzle as its injection opening.

10. The fuel injection system of claim 5 wherein the injector (18) has a vario-nozzle or vario-register nozzle as its injection opening.

11. The pressure-controlled fuel injection system of claim 5 wherein a nozzle chamber (100) of the injector (88) communicates with a spring chamber (89) of the injector (88) via a connecting line (92) that contains a pressure relief throttle (90).

12. In a fuel injection system for an internal combustion engine, the system having a pressure storage chamber (6; 36) and one injector (8; 18; 38; 58; 68; 78; 88), assigned to each engine cylinder, that can be connected to the pressure storage chamber (6; 36) via a pressure line (7; 37; 77; 107) containing a metering valve (9; 39), the improvement wherein the metering valve (9; 39) is a 2/2-way valve, and that the fuel injection is effected in pressure-controlled fashion, wherein the injector (18) has a vario- nozzle or vario-register nozzle as its injection opening.

13. In a fuel injection system for an internal combustion engine, the ago system having a pressure storage chamber (6; 36) and one injector (8; 18; 38; 58; 68; 78; 88), assigned to each engine cylinder, that can be connected to the pressure storage chamber (6; 36) via a pressure line (7; 37; 77; 107) containing a metering valve (9; 39), the improvement wherein the metering valve (9; 39) is a 2/2-way valve, and that the fuel injection is effected in pressure-controlled fashion, wherein a nozzle chamber (100) of the injector (88) communicates with a spring chamber (89) of the injector (88) via a connecting line (92) that contains a pressure relief throttle (90).

14. In a fuel injection system for an internal combustion engine, the system having a pressure storage chamber (6; 36) and one injector (8; 18; 38; 58; 78; 88), assigned to each engine cylinder, that can be connected to the pressure storage chamber (6; 36) via a pressure line (7; 37; 77; 107) containing a metering valve (9; 39), the improvement wherein the metering valve (9; 39) is a 2/2-way valve, and that the fuel injection is effected in pressure-controlled fashion, wherein one pressure line (37) each is connected to a leakage line via at least one pressure relief throttle (40) and, wherein the injector (18) has a vario-nozzle or vario-register nozzle as its injection opening.

15. In a fuel injection system for an internal combustion engine, the system having a pressure storage chamber (6; 36) and one injector (8; 18; 38; 58; 78; 88), assigned to each engine cylinder, that can be connected to the pressure storage chamber (6; 36) via a pressure line (7; 37; 77; 107) containing a metering valve (9; 39), the improvement wherein the metering valve (9; 39) is a 2/2-way valve, and that the fuel injection is effected in pressure-controlled fashion, wherein the injector (8) has a seat or blind bore nozzle as its injection opening, and wherein the injector (18) has a vario-nozzle or vario-register nozzle as its injection opening.

16. In a fuel injection system for an internal combustion engine, the system having a pressure storage chamber (6; 36) and one injector (8; 18; 38; 58; 68; 78; 88), assigned to each engine cylinder, that can be connected to the pressure storage chamber (6; 36) via a pressure line (7; 37; 77; 107) containing a metering valve (9; 39), the improvement wherein the metering valve (9; 39) is a 2/2-way valve, and that the fuel injection is effected in pressure-controlled fashion, wherein one pressure line (37) each is connected to a leakage line via at least one pressure relief throttle (40), and wherein a nozzle chamber (100) of the injector (88) communicates with a spring chamber (89) of the injector (88) via a connecting line (92) that contains a pressure relief throttle (90).

* * * * *